US012727735B2

(12) United States Patent
Kremmel et al.

(10) Patent No.: US 12,727,735 B2
(45) Date of Patent: Sep. 8, 2026

(54) MOLDED PULP EXTERNAL PACKING MEMBER FOR A DISHWASHER APPLIANCE

(71) Applicant: Haier US Appliance Solutions, Inc., Wilmington, DE (US)

(72) Inventors: Aldo Vincent Kremmel, Palmyra, IN (US); Kyle James Brewer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 58 days.

(21) Appl. No.: 18/795,559

(22) Filed: Aug. 6, 2024

(65) Prior Publication Data

US 2026/0041303 A1 Feb. 12, 2026

(51) Int. Cl.
*A47L 15/42* (2006.01)
*B65D 65/42* (2006.01)

(52) U.S. Cl.
CPC ..... *A47L 15/4268* (2013.01); *B65D 65/42* (2013.01)

(58) Field of Classification Search
CPC ..... A47L 15/4268
See application file for complete search history.

(56) References Cited

U.S. PATENT DOCUMENTS 10,136,792 B2 11/2018 Bak et al.
2024/0034546 A1 2/2024 Juen et al.

FOREIGN PATENT DOCUMENTS

DE 4446961 C2 3/1997

*Primary Examiner* — Jason Y Ko
(74) *Attorney, Agent, or Firm* — Dority & Manning, P.A.

(57) ABSTRACT

An external pack member for a dishwasher appliance, the external pack member includes a base panel extending along the lateral direction and the transverse direction; a first channel formed downward into a top surface of the base panel along the vertical direction and extending along the lateral direction; and a second channel formed upward along the vertical direction into a bottom surface of the base panel and extending along the lateral direction, wherein the external pack member is formed from a recyclable molded pulp material.

18 Claims, 5 Drawing Sheets

MOLDED PULP EXTERNAL PACKING MEMBER FOR A DISHWASHER APPLIANCE

FIELD OF THE INVENTION

The present subject matter relates generally to domestic appliances, and more particularly to packing materials for dishwasher appliances.

BACKGROUND OF THE INVENTION

Dishwasher appliances generally include a tub defining a receive space, a door to open and close the tub, and one or more racks removable positioned within the receiving space. A latch assembly or mechanism is included to maintain the door in a closed state during a washing operation to avoid water leakage. Often, the latch assembly includes one or more narrow operating windows in the form of a receiving groove in which a latch pawl or protrusion is accepted. Such narrow windows may be susceptible to damage during packaging, transportation, and delivery.

Conventional dishwasher appliance may include blocks, ties, padding, or other securing features to protect elements of the appliance, such as the door, the latch assembly, or the like from damage during such packaging and delivery. For instance, many padding or packaging materials are made from non-recyclable foam such as polystyrene foam, expandable polystyrene foam, or the like. Further, existing forming and creation methods of such pieces limit specific shapes, sizes, or features, leading to limited usability and full function.

Accordingly, a packaging piece for a dishwasher appliance which obviates one or more of the above-mentioned drawbacks would be beneficial. In particular, a molded pulp rack packaging piece would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an external pack member for a dishwasher appliance is provided. The dishwasher appliance may include a tub. The external pack member may include a base panel extending along the lateral direction and the transverse direction; a first channel formed downward into a top surface of the base panel along the vertical direction and extending along the lateral direction; and a second channel formed upward along the vertical direction into a bottom surface of the base panel and extending along the lateral direction, wherein the external pack member is formed from a recyclable molded pulp material.

In another exemplary aspect of the present disclosure, a dishwasher appliance is provided. The dishwasher appliance may include a tub defining a receiving chamber; a door attached to the tub and movable between an open position and a closed position to provide selective access to the receiving chamber; and an external pack member removably coupled to a top of the tub adjacent to the door. The external pack member may include a base panel extending along the lateral direction and the transverse direction; a first channel formed downward into a top surface of the base panel along the vertical direction and extending along the lateral direction; and a second channel formed upward along the vertical direction into a bottom surface of the base panel and extending along the lateral direction, wherein the external pack member is formed from a recyclable molded pulp material.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
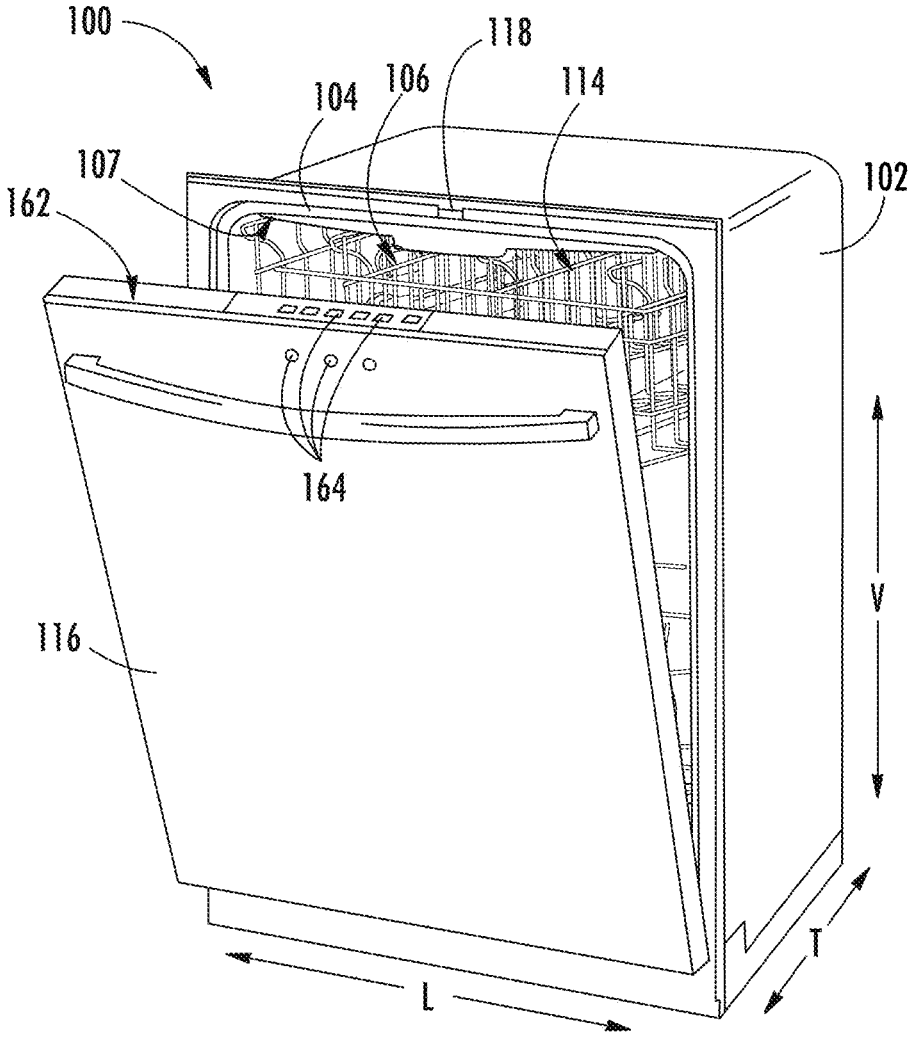
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
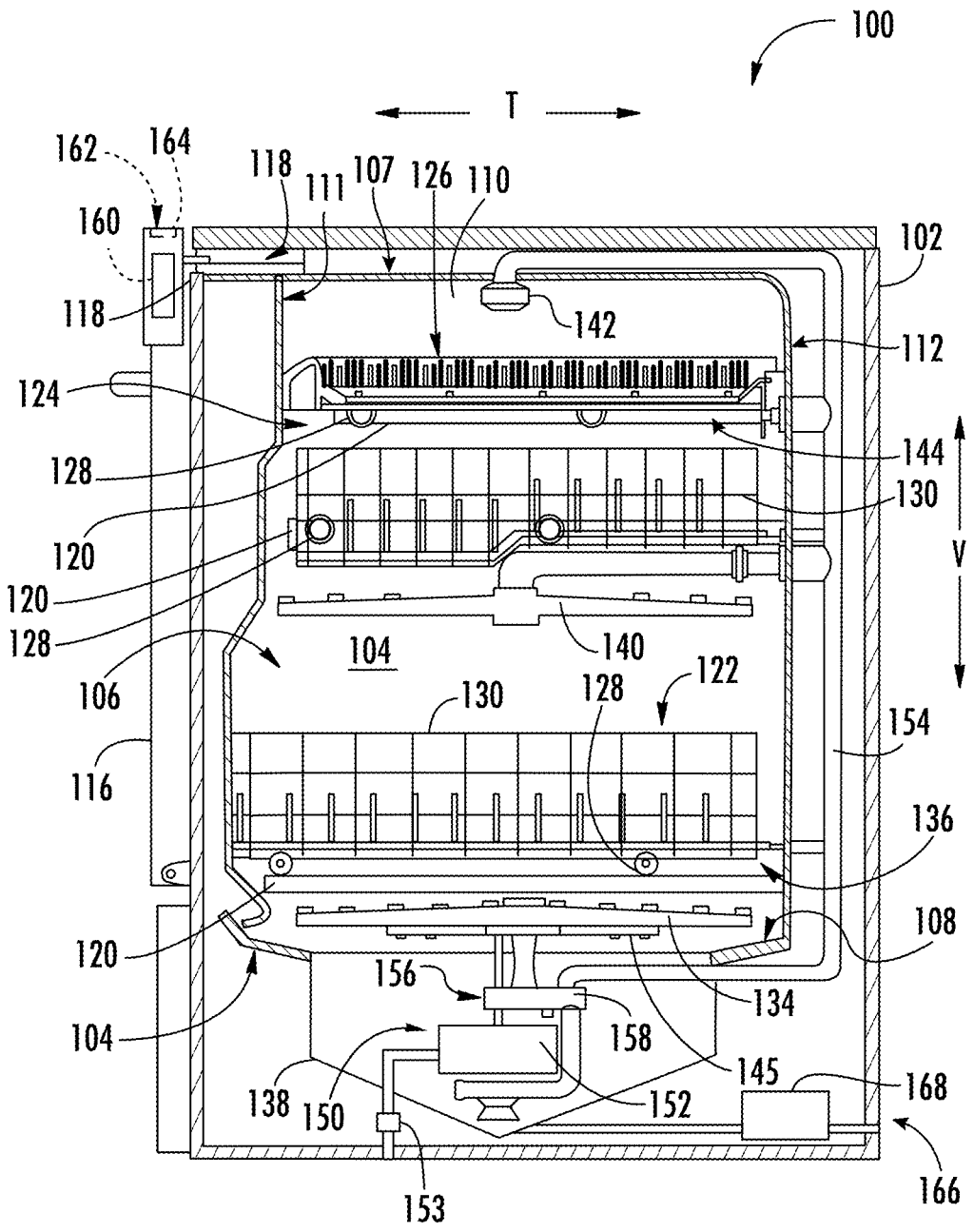
FIG. 2 provides a side, cross-sectional view of the exemplary dishwashing appliance of FIG. 1.

Turning now to the figures, FIGS. 1 and 2 depict an exemplary dishwasher or dishwasher appliance (e.g., dishwasher appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 may include a cabinet 102 having a tub 104 therein that defines a wash chamber 106. As shown in FIG. 2, tub 104 extends between a top 107 and a bottom 108 along the vertical direction V, between a pair of side walls 110 along the lateral direction L, and between a front side 111 and a rear side 112 along the transverse direction T.

Tub 104 may include a front opening 114 (FIG. 1). In some embodiments, dishwasher appliance 100 may also include a door 116 at the front opening 114. Door 116 may, for example, be hinged at its bottom for movement between a normally closed vertical position, wherein wash chamber 106 is sealed shut for washing operations, and a horizontal open position for loading and unloading of articles from dishwasher 100. A door closure mechanism or assembly 118 may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122, a middle rack assembly 124, or an upper rack assembly 126. In some such embodiments, upper rack assembly 126 is positioned at a top portion of wash chamber 106 above middle rack assembly 124, which is positioned above lower rack assembly 122 along the vertical direction V.

Generally, each rack assembly 122, 124, 126 may be adapted for movement between an extended loading position (not shown) in which the rack is substantially positioned outside the wash chamber 106, and a retracted position (shown in FIGS. 1 and 2) in which the rack is located inside the wash chamber 106. In some embodiments, movement is facilitated, for instance, by rollers 128 mounted onto rack assemblies 122, 124, 126, respectively. Although guide rails 120 and rollers 128 are illustrated herein as facilitating movement of the respective rack assemblies 122, 124, 126, it should be appreciated that any suitable sliding mechanism or member may be used according to alternative embodiments.

In optional embodiments, some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash liquid to reach and impinge on those articles (e.g., during a cleaning or rinsing cycle). According to additional or alternative embodiments, a silverware basket (FIG. 5) may be removably attached to a rack assembly (e.g., lower rack assembly 122), for placement of silverware, utensils, and the like, that are otherwise too small to be accommodated by the rack assembly.

Generally, dishwasher 100 may include one or more spray assemblies for urging a flow of fluid (e.g., wash liquid) onto the articles placed within wash chamber 106. In exemplary embodiments, dishwasher 100 includes a lower spray arm assembly 134 disposed in a lower region 136 of wash chamber 106 and above a sump 138 so as to rotate in relatively close proximity to lower rack assembly 122.

In additional or alternative embodiments, a mid-level spray arm assembly 140 is located in an upper region of wash chamber 106 (e.g., below and in close proximity to middle rack assembly 124). In this regard, mid-level spray arm assembly 140 may generally be configured for urging a flow of wash liquid up through middle rack assembly 124 and upper rack assembly 126.

In further additional or alternative embodiments, an upper spray assembly 142 is located above upper rack assembly 126 along the vertical direction V. In this manner, upper spray assembly 142 may be generally configured for urging or cascading a flow of wash liquid downward over rack assemblies 122, 124, and 126.

In yet further additional or alternative embodiments, upper rack assembly 126 may further define an integral spray manifold 144. As illustrated, integral spray manifold 144 may be directed upward, and thus generally configured for urging a flow of wash liquid substantially upward along the vertical direction V through upper rack assembly 126.

In still further additional or alternative embodiments, a filter clean spray assembly 145 is disposed in a lower region 136 of wash chamber 106 (e.g., below lower spray arm assembly 134) and above a sump 138 so as to rotate in relatively close proximity to a filter assembly 210 (e.g., FIG. 4). For instance, filter clean spray assembly 145 may be directed downward to urge a flow of wash liquid across a portion of filter assembly 210 (FIG. 4) or sump 138.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be located within sump 138 or within a machinery compartment located below sump 138 of tub 104.

When assembled, circulation pump 152 may be in fluid communication with an external water supply line (not shown) and sump 138. A water inlet valve 153 may be positioned between the external water supply line and circulation pump 152 (e.g., to selectively allow water to flow from the external water supply line to circulation pump 152). Additionally or alternatively, water inlet valve 153 may be positioned between the external water supply line and sump 138 (e.g., to selectively allow water to flow from the external water supply line to sump 138). During use, water inlet valve 153 may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 2, a primary supply conduit 154 extends from circulation pump 152, along rear 112 of tub 104 along the vertical direction V to supply wash liquid throughout wash chamber 106.

In some embodiments, primary supply conduit 154 is used to supply wash liquid to one or more spray assemblies (e.g., to mid-level spray arm assembly 140 or upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, primary supply conduit 154 could be used to provide wash liquid to mid-level spray arm assembly 140 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray arm assembly 134 and 140, upper spray assembly 142, integral spray manifold 144, filter clean assembly 145, or other spray device may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 140, 142, 145 may be motor-driven, or may operate using any other suitable drive mechanism. Spray manifolds and assemblies may also be stationary. The resultant movement of the spray assemblies 134, 140, 142, 145 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

In optional embodiments, circulation pump 152 urges or pumps wash liquid (e.g., from filter assembly 210) to a diverter 156 (FIG. 2). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 140, 142, or other spray manifolds. For instance, the diverter disk may have a plurality of apertures that are configured to align with one or more outlet ports (not shown) at the top of diverter chamber 158. In this manner, the diverter disk may be selectively rotated to provide wash liquid to the desired spray device.

In exemplary embodiments, diverter 156 is configured for selectively distributing the flow of wash liquid from circulation pump 152 to various fluid supply conduits—only some of which are illustrated in FIG. 2 for clarity. In certain embodiments, diverter 156 includes four outlet ports (not shown) for supplying wash liquid to a first conduit for rotating lower spray arm assembly 134, a second conduit for supplying wash liquid to filter clean assembly 145, a third conduit for spraying an auxiliary rack such as the silverware rack, and a fourth conduit for supply mid-level or upper spray assemblies 140, 142 (e.g., primary supply conduit 154).

Figure 3:
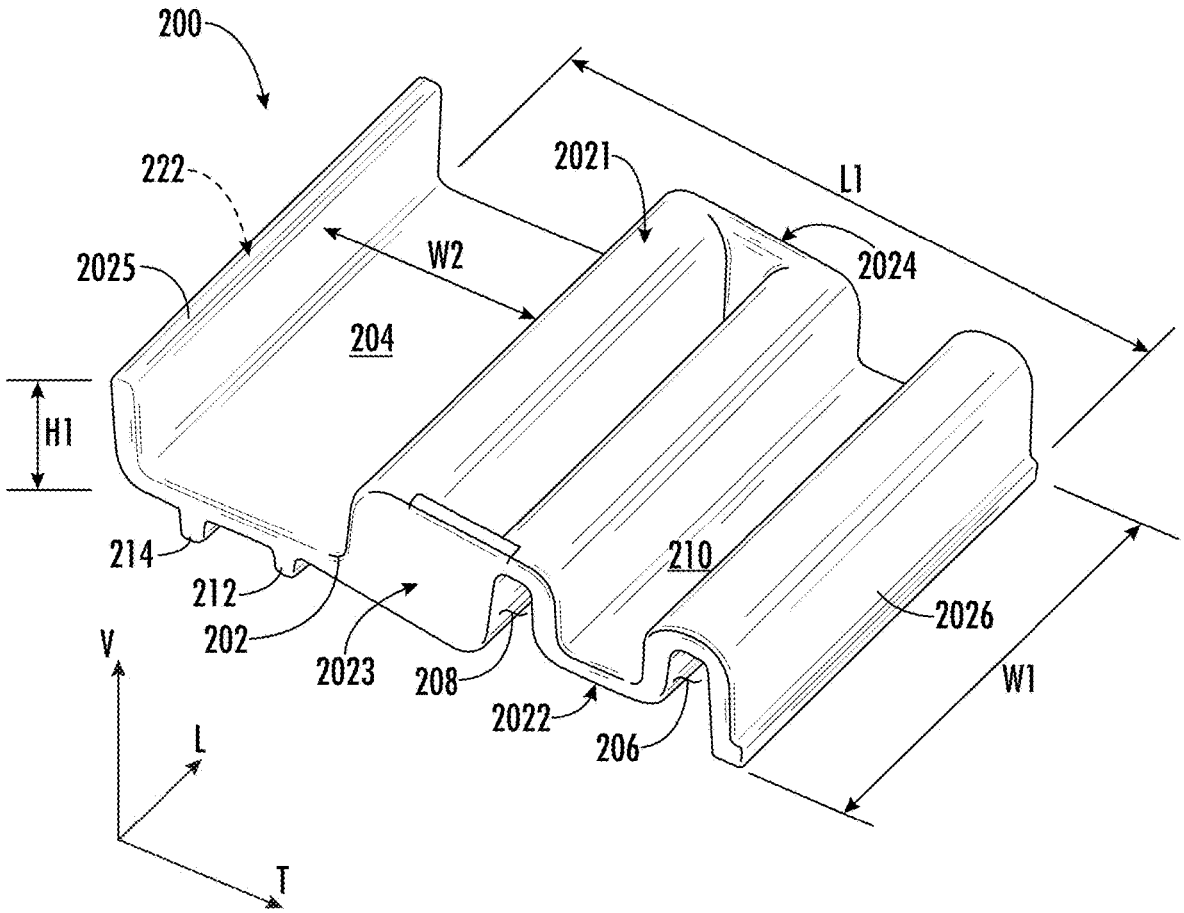
FIG. 3 provides a perspective view of external pack member for a dishwasher appliance according to exemplary embodiments of the present disclosure.
Figure 4:
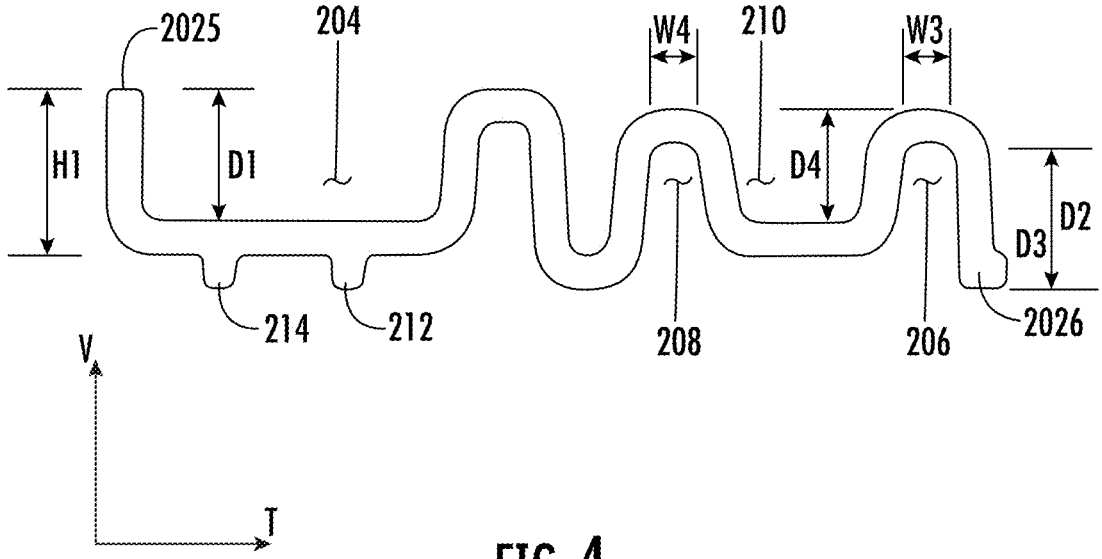
FIG. 4 provides a side-section view of the exemplary external pack member of FIG. 3.
Figure 5:
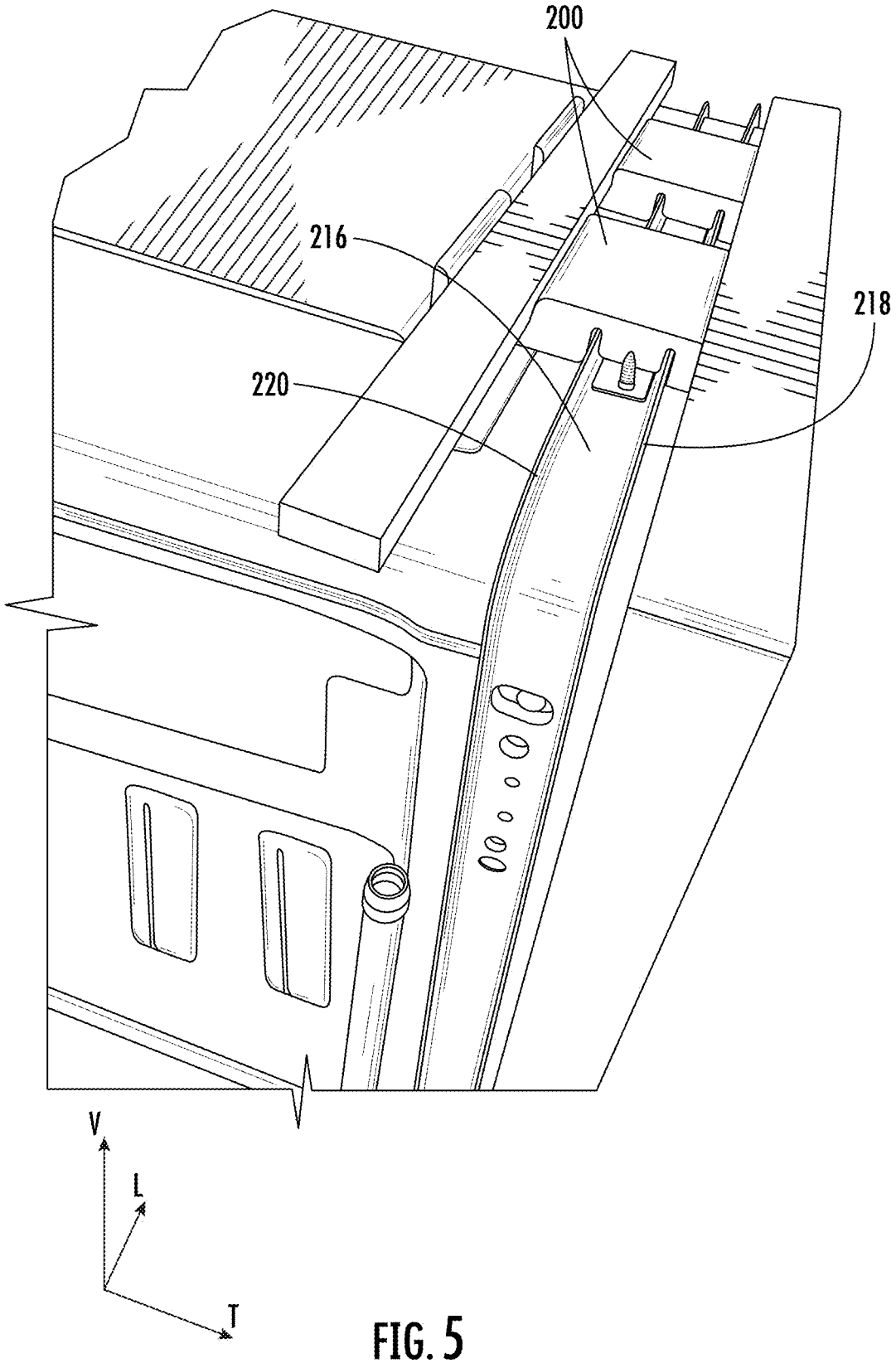
FIG. 5 provides a perspective view of a tub of the exemplary dishwashing appliance of FIG. 1 with the external pack member in an installed position.

Referring now to FIGS. 3 through 5, an exemplary packaging piece will be described in detail. Dishwasher 100 may include one or more packaging materials which secure or protect pieces (e.g., door 116, latch assembly 118, etc.) during packing and transport of the appliance. The packaging materials may include an external pack member 200. External pack member 200 may be selectively attached or positioned along an outer surface of tub 104 (e.g., an upper external surface of tub 104 adjacent to door 116). External pack member 200 may serve to provide stability and protection to certain sensitive elements at or near door 116, such as latch assembly 118, any gaskets between door 116 and tub 104, electronics, or the like. Additionally or alternatively, external pack member 200 may provide a locating feature for a clamp bar. The clamp bar may be used in transport to receive a load or force from an external clamping mechanism such as a lift to avoid damage or deformation to appliance 100.

External pack member 200 may be formed from a molded pulp material. In detail, molded pulp may include one or more recycled or recyclable materials, such as recycled paperboard, newsprint, paper packaging, cardboard, or the like. External pack member 200 may include thick-walled molded, or slush molded pulp material capable of providing rigidity and maintaining shape through minor force applied thereto. In additional or alternative embodiments, external pack member 200 include thin-walled molded pulp, including two or more layers of thin-walled molded pulp to form a single external pack member 200. However, it should be understood that the disclosure is not limited to the examples provided herein, and external pack member 200 may include thermoformed fiber molded pulp, processed molded pulp, any combination of two or more forms of molded pulp, or the like.

External pack member 200 may include a base panel 202. Base panel 200 may extend along the lateral direction L and the transverse direction T (e.g., when external pack member 200 is in the installed position). Base panel 202 may be predominantly rectangular in shape. For instance, base panel 202 may define a length L1 along the transverse direction T, a width W1 along the lateral direction L, and a height H1 along the vertical direction V. According to at least some embodiments, a ratio of height H1 to width W1 to length L1 is about 1:5:8. It should be noted that the dimensions provided herein are by way of example only, and base panel 202 may have any suitable size or shape according to specific embodiments.

Base panel 202 may define a top surface 2021 and a bottom surface 2022 opposite top surface 2021. For instance, top surface 2021 may face upward along the vertical direction V (e.g., when external pack member 200 is in the installed position). Accordingly, bottom surface 2022 may face downward along the vertical direction V (e.g., toward a top external surface of tub 104). Additionally or alternatively, base panel 202 may define a first lateral side surface 2023 and a second lateral side surface 2024 opposite first lateral side surface 2023. As would be understood, each of first lateral side surface 2023 and second lateral side surface 2024 may be connected with top surface 2021 and bottom surface 2022.

Base panel 202 may have a first channel 204 formed therein. In detail, first channel 204 may be formed downward into top surface 2021 of base panel 202 (e.g., along the vertical direction V). Moreover, first channel 204 may extend along the lateral direction L. For instance, first channel 204 may extend for the entire width W1 of base panel 202. In other words, first channel 204 may be open at each of first lateral side surface 2023 and second lateral side surface 2024.

First channel 204 may define a depth D1 along the vertical direction and a width W2 along the transverse direction T. Depth D1 of first channel 204 may be between about 70% and about 90% of height H1 of base panel 202. Width W2 of first channel 204 may be between about 20% and about 40% of total length L1 of base panel 202. Additionally or alternatively, first channel 204 may be positioned at or near a rear edge of base panel 202. For instance, base panel 202 may define a rear flange 2025. Rear flange 2025 may extend upward along the vertical direction V from bottom surface 2022 of base panel 202. Rear flange 2025 may form or define a rear end or wall of external pack member 202. Thus, rear flange 2025 may at least partially form or define first channel 204 (e.g., a rear portion thereof along the transverse direction T).

Base panel 202 may have a second channel 206 formed therein. In detail, second channel 206 may be formed upward into bottom surface 2022 of base panel 202 (e.g., along the vertical direction V). Moreover, second channel 206 may extend along the lateral direction L. For instance, second channel 206 may extend for the entire width W1 of base panel 202. In other words, second channel 206 may be open at each of first lateral side surface 2023 and second lateral side surface 2024.

Second channel 206 may define a depth D2 along the vertical direction (e.g., upward along the vertical direction V) and a width W3 along the transverse direction T. Depth D2 of second channel 206 may be between about 70% and about 90% of height H1 of base panel 202. Width W3 of second channel 206 may be between about 5% and about 30% of total length L1 of base panel 202. Additionally or alternatively, second channel 206 may be positioned at or near a front edge of base panel 202. For instance, base panel 202 may define a front flange 2026. Front flange 2026 may extend downward along the vertical direction V from top surface 2021 of base panel 202. Front flange 2026 may form or define a front end or wall of external pack member 202. Thus, front flange 2026 may at least partially form or define second channel 206 (e.g., a front portion thereof along the transverse direction T).

According to some embodiments, base panel 202 may include a third channel 208. Third channel 208 may be formed upward into bottom surface 2022 of base panel 202 (e.g., along the vertical direction V). Moreover, third channel 208 may extend along the lateral direction L. For instance, third channel 208 may extend for the entire width W1 of base panel 202. In other words, third channel 208 may be open at each of first lateral side surface 2023 and second lateral side surface 2024.

Third channel 208 may define a depth D3 along the vertical direction (e.g., upward along the vertical direction V) and a width W4 along the transverse direction T. Depth D3 of third channel 208 may be between about 70% and about 90% of height H1 of base panel 202. Width W4 of third channel 208 may be between about 5% and about 30% of total length L1 of base panel 202. Moreover, third channel 208 may be positioned adjacent to second channel 206 (e.g., along the transverse direction T). For instance, third channel 208 may be positioned inward from second channel 206 along the transverse direction T (e.g., toward a rear of base plate 202).

In some embodiments, external pack member 200 includes a fourth channel 210. Fourth channel 210 may be formed downward into top surface 2021 of base panel 202 (e.g., along the vertical direction V). Moreover, fourth channel 210 may extend along the lateral direction L. For instance, fourth channel 210 may extend for the entire width W1 of base panel 202. In other words, fourth channel 210 may be open at each of first lateral side surface 2023 and second lateral side surface 2024. Additionally or alternatively, fourth channel 210 may include one or more cross supports (not shown). For instance, a plurality of supports may be positioned within fourth channel 210 and extend predominantly along the transverse direction. In some embodiments, a honeycomb structure or design is provided or formed via the plurality of supports.

Fourth channel 210 may be positioned between second channel 206 and third channel 208 (e.g., along the transverse direction T). For instance, base panel 202 may define a meandering, undulating, serpentine, or otherwise circuitous path defined along the transverse direction T (e.g., from a front edge to a rear edge as shown in FIG. 4). Accordingly, fourth channel 210 may resemble a protrusion protruding downward along the vertical direction V from top surface 2021 of base panel 202 (e.g., between second channel 206 and third channel 208) and extending along the lateral direction L.

Fourth channel 210 may define a depth D4 along the vertical direction V (e.g., downward along the vertical direction V). Depth D4 of fourth channel 210 may be substantially equal to depth D1 of first channel 204. Additionally or alternatively, depth D4 may be less than a total height along the vertical direction V of front flange 2026. Accordingly, as best shown in FIG. 4, a bottom face of fourth channel may be positioned above a bottom edge of front flange 2026.

External pack member 200 may include a pair of ribs. In detail, the pair of ribs may include a first rib 212 and a second rib 214. Each of the first rib 212 and the second rib 214 may protrude from bottom surface 2022 of base panel 202 (e.g., downward along the vertical direction V). First rib 212 and second rib 214 may be positioned below first channel 204. Additionally or alternatively, first rib 212 and second rib 214 may be spaced apart from each other along the transverse direction T. First rib 212 and second rib 214 may extend along the lateral direction L. For instance, first rib 212 and second rib 214 may extend the entire width W1 of base panel 202 along the lateral direction L.

With reference to FIG. 5, dishwasher appliance 100 may include an installation bracket 216. Installation bracket 216 may be installed at an outer surface of tub 104. For instance, installation bracket 216 may be attached to the outer surface of tub 104 adjacent to door 116. Installation bracket 216 may extend along the lateral direction L (e.g., at a top of tub 104). Additionally or alternatively, installation bracket 216 may extend along the vertical direction V at either lateral side of tub 104. At least a portion of installation bracket 216 may be positioned within second channel 206 (e.g., when external pack member 200 is in the installed position).

Installation bracket 216 may include a first lip 218. First lip 218 may protrude upward along the vertical direction V (e.g., away from tub 104). First lip 218 may extend along the lateral direction L. For instance, first lip 218 may extend for a predetermined length along the lateral direction L across the top of tub 104. According to at least some embodiments, first lip 218 may extend for an entire width of tub 104. First lip 218 may be provided adjacent to door 116 (e.g., offset from door 116 along the transverse direction T).

Installation bracket 216 may include a second lip 220. Second lip 220 may protrude upward along the vertical direction V (e.g., away from tub 104). Second lip 220 may extend along the lateral direction L. For instance, second lip 220 may extend for a predetermined length along the lateral direction L across the top of tub 104. According to at least some embodiments, second lip 220 extends for an entire width of tub 104. Second lip 220 may be spaced apart from first lip 118 (e.g., along the transverse direction T). For instance, second lip 220 may be positioned behind first lip 218 along the transverse direction T (e.g., toward a rear of appliance 100).

First lip 218 may be positioned within second channel 206 of external pack member 200 (e.g., when external pack member 200 is in the installed position). As mentioned above, second channel 206 may be open on either lateral side of external pack member 200. Thus, external pack member 200 may be positioned at any suitable lateral location along installation bracket 216. Additionally or alternatively, second lip 220 may be positioned within third channel 208 of external pack member 200. Advantageously, external pack member 200 may be restricted from moving along the transverse direction T during shipping of appliance 100 through the physical interaction between installation bracket 216 (e.g., first lip 218 and second lip 220) and at least one of second channel 206 or third channel 208.

According to some embodiments, external pack member 200 may include a coating 222. Coating 222 may be applied to external pack member 200 after a formation thereof. As mentioned, external pack member 200 may be formed from a recyclable molded pulp material (e.g., through shaping, compressing, etc.). Once the general shape of external pack member 200 is defined, external pack member 200 may be provided with coating 222 (e.g., by dipping, painting, spraying, or the like). Coating 222 may include a wax coating. Advantageously, external pack member 200 may be waterproofed before being installed to tub 104 (or any other portion or member within or outside of appliance 100).

According to some embodiments, external pack member 200 includes a hinge. The hinge may couple, for instance, rear flange 2025 to a locking tab. The hinge may include a living hinge. For instance, the locking tab may be formed as part of external pack member 200 that is at least partially elastic. Thus, the locking tab may selectively deform with respect to external pack member 200 to allow external pack member 200 to be securely attached to, e.g., a clamp bar positioned within first channel 204.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance defining a vertical direction, a lateral direction, and a transverse direction, the dishwasher appliance comprising:

a tub defining a receiving chamber;

a door attached to the tub and movable between an open position and a closed position to provide selective access to the receiving chamber; and an external pack member removably coupled to a top of the tub adjacent to the door, the external pack member comprising:

a base panel extending along the lateral direction and the transverse direction;

a first channel recessed downward into a top surface of the base panel along the vertical direction and extending along the lateral direction; and a second channel recessed upward along the vertical direction into a bottom surface of the base panel and extending along the lateral direction, wherein the external pack member is formed from a recyclable molded pulp material.

2. The dishwasher appliance of claim 1, wherein the external pack member further comprises:

a third channel recessed upward along the vertical direction into the bottom surface of the base panel and extending along the lateral direction.

3. The dishwasher appliance of claim 2, further comprising:

an installation bracket installed at an outer surface of the tub adjacent to the door, wherein at least a portion of the installation bracket is positioned within the second channel when the external pack member is in an installed position.

4. The dishwasher appliance of claim 3, wherein the installation bracket comprises:

a first lip protruding upward along the vertical direction and extending along the lateral direction; and a second lip protruding upward along the vertical direction and extending along the lateral direction, the second lip being spaced apart from the first lip along the transverse direction, wherein the first lip is positioned within the second channel of the external pack member and the second lip is positioned within the third channel of the external pack member when the external pack member is in the installed position.

5. The dishwasher appliance of claim 2, wherein the external pack member further comprises:

a fourth channel recessed downward along the vertical direction into the top surface of the base panel and extending along the lateral direction.

6. The dishwasher appliance of claim 5, wherein the fourth channel is positioned between the second channel and the third channel along the transverse direction, and the first channel is positioned behind the third channel along the transverse direction toward a rear of the dishwasher appliance.

7. The dishwasher appliance of claim 1, wherein the external pack member further comprises:

a pair of ribs protruding from the bottom surface of the base panel below the first channel, each of the pair of ribs extending along the lateral direction.

8. The dishwasher appliance of claim 1, wherein a width of the first channel along the transverse direction is between 20% and 40% of a total length of the base panel.

9. The dishwasher appliance of claim 1, wherein the external pack member comprises a wax coating.

10. An external pack member for packaging a dishwasher appliance, the dishwasher appliance defining a vertical direction, a lateral direction, and a transverse direction and comprising a tub, the external pack member comprising:

a base panel extending along the lateral direction and the transverse direction;

a first channel recessed downward into a top surface of the base panel along the vertical direction and extending along the lateral direction; and a second channel recessed upward along the vertical direction into a bottom surface of the base panel and extending along the lateral direction, wherein the external pack member is formed from a recyclable molded pulp material.

11. The external pack member of claim 10, further comprising:

a third channel recessed upward along the vertical direction into the bottom surface of the base panel and extending along the lateral direction.

12. The external pack member of claim 11, wherein the dishwasher appliance further comprises:

an installation bracket installed at an outer surface of the tub, wherein at least a portion of the installation bracket is positioned within the second channel when the external pack member is in an installed position.

13. The external pack member of claim 12, wherein the installation bracket comprises:

a first lip protruding upward along the vertical direction and extending along the lateral direction; and a second lip protruding upward along the vertical direction and extending along the lateral direction, the second lip being spaced apart from the first lip along the transverse direction, wherein the first lip is positioned within the second channel of the external pack member and the second lip is positioned within the third channel of the external pack member when the external pack member is in the installed position.

14. The external pack member of claim 11, further comprising:

a fourth channel recessed downward along the vertical direction into the top surface of the base panel and extending along the lateral direction.

15. The external pack member of claim 14, wherein the fourth channel is positioned between the second channel and the third channel along the transverse direction, and the first channel is positioned behind the third channel along the transverse direction toward a rear of the dishwasher appliance.

16. The external pack member of claim 10, further comprising:

a pair of ribs protruding from the bottom surface of the base panel below the first channel, each of the pair of ribs extending along the lateral direction.

17. The external pack member of claim 10, wherein a width of the first channel along the transverse direction is between 20% and 40% of a total length of the base panel.

18. The external pack member of claim 10, further comprising a wax coating over an exterior of the external pack member.

* * * * *